US008064785B2

(12) United States Patent
Fujii et al.

(10) Patent No.: US 8,064,785 B2
(45) Date of Patent: Nov. 22, 2011

(54) FIXING DEVICE, IMAGE FORMING APPARATUS, AND METHOD OF DETECTING AN ABNORMALITY OF A FIXING DEVICE

(75) Inventors: Shuhji Fujii, Kizukawa (JP); Yuji Okamoto, Kyoto (JP); Yuji Nakagawa, Kyoto (JP); Takashi Nakagawa, Nara (JP); Shinji Kato, Osaka (JP); Kaoru Ishikura, Kyoto (JP); Nobuyuki Ueda, Nara (JP); Atsushi Ogo, Kizukawa (JP)

(73) Assignee: Sharp Kabushiki Kaisha, Osaka (JP)

( * ) Notice: Subject to any disclaimer, the term of this patent is extended or adjusted under 35 U.S.C. 154(b) by 345 days.

(21) Appl. No.: 12/393,775

(22) Filed: Feb. 26, 2009

(65) Prior Publication Data

US 2009/0214234 A1 Aug. 27, 2009

(30) Foreign Application Priority Data

Feb. 27, 2008 (JP) ..... 2008-045779

(51) Int. Cl.
*G03G 15/20* (2006.01)

(52) U.S. Cl. ..... 399/33; 399/69; 399/330; 219/216

(58) Field of Classification Search ..... 399/9, 33, 399/38, 67, 69, 122, 328, 330, 334; 219/216, 219/244

See application file for complete search history.

(56) References Cited

U.S. PATENT DOCUMENTS

| | | | | |
|---|---|---|---|---|
| 5,600,406 | A * | 2/1997 | Aikawa et al. | 399/70 |
| 6,597,879 | B2 * | 7/2003 | Akutsu et al. | 399/69 |
| 2006/0088328 | A1 * | 4/2006 | Yoshimura et al. | 399/69 |

FOREIGN PATENT DOCUMENTS

| | | | |
|---|---|---|---|
| JP | 2-309382 | A | 12/1990 |
| JP | 3-62207 | | 3/1991 |
| JP | 5-35146 | A | 2/1993 |
| JP | 7-287473 | A | 10/1995 |
| JP | 2006-243652 | | 9/2006 |

* cited by examiner

*Primary Examiner* — David Porta
*Assistant Examiner* — Benjamin Schmitt
(74) *Attorney, Agent, or Firm* — Birch, Stewart, Kolasch & Birch, LLP

(57) ABSTRACT

A fixing device according to this invention includes a heating roller, a heater driver, a thermistor, and a CPU. The heating roller has a heater and heats a recording sheet. The heater driver drives the heater. The thermistor detects a surface temperature of the heating roller. The CPU stops an operation of the heater driver when the surface temperature of the heating roller becomes higher than a predetermined temperature and, thereafter, causes the thermistor to perform detection of the surface temperature of the heating roller for a predetermined time period and issues an alarm about occurrence of a first abnormality when the surface temperature of the heating roller fails to drop in the predetermined time period.

7 Claims, 6 Drawing Sheets

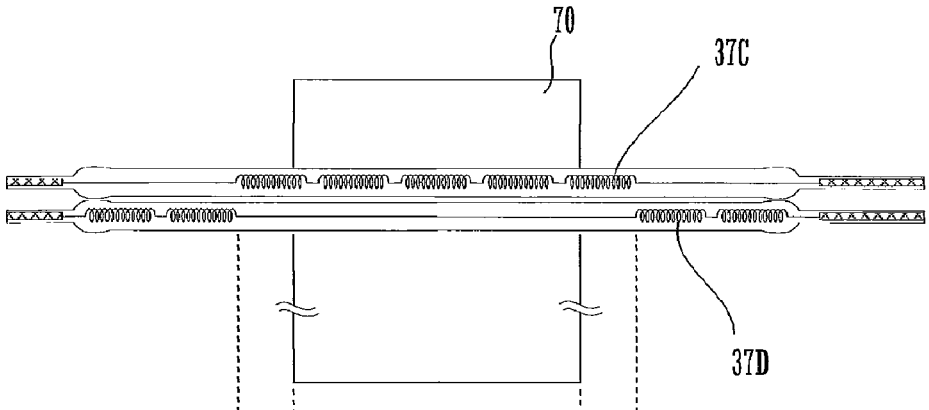
Fig.3A
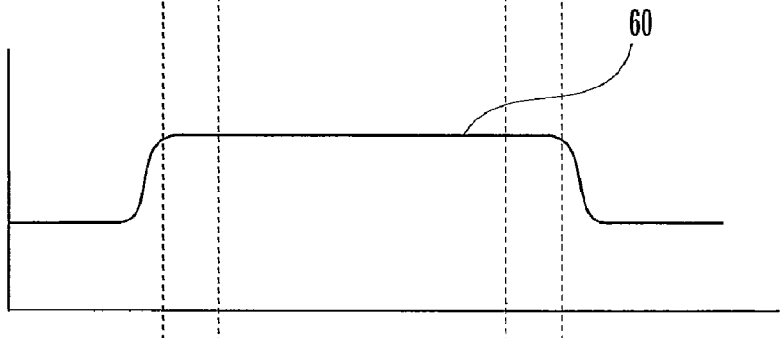
Fig.3B
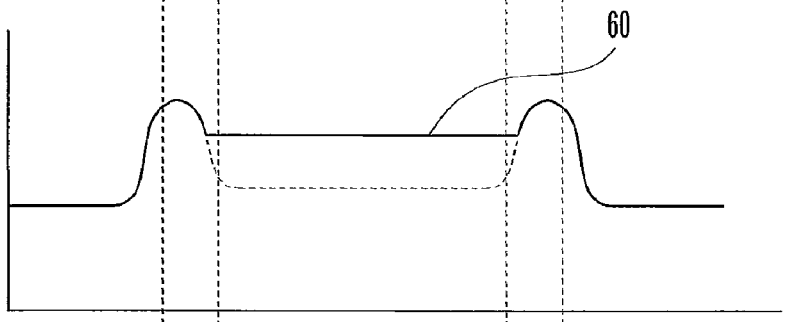
Fig.3C
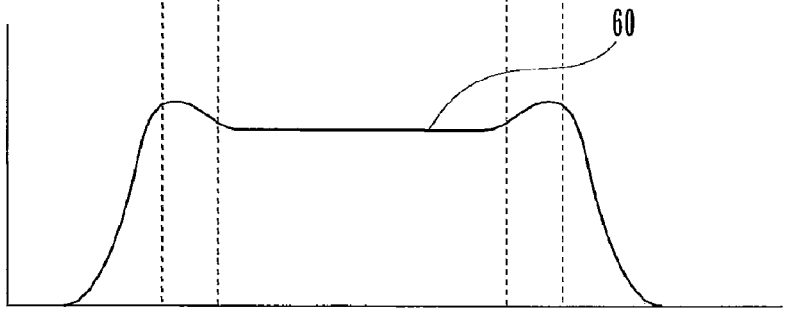

FIXING DEVICE, IMAGE FORMING APPARATUS, AND METHOD OF DETECTING AN ABNORMALITY OF A FIXING DEVICE

CROSS REFERENCE

This Nonprovisional application claims priority under 35 U.S.C. §119(a) on Patent Application No. 2008-045779 filed in Japan on Feb. 27, 2008, the entire contents of which are hereby incorporated by reference.

BACKGROUND OF THE INVENTION

1. Field of the Invention

The present invention relates to a fixing device for fixing an image to a recording medium, an image forming apparatus including the fixing device, and a method of detecting an abnormality of the fixing device.

2. Description of the Related Art

With fixing devices used in image forming apparatuses developed in recent years, there has been a danger that a fire breaks out because of the temperature of a heating roller continuing to rise when the heating roller is entwined with recording sheet. This is because a power source for a heater heating the heating roller, which forms a fixing roller, fails to be turned OFF for the reason that the temperature detected by a temperature detecting member remains low in spite of the heating roller heated to a predetermined fixing temperature by the heater. In order to avoid such a danger, a method has been proposed which includes providing two temperature detecting members at a recording sheet passage point and at a point other than the recording sheet passage point, and detecting occurrence of entwining with recording sheet by utilizing the difference between the temperatures detected by the two temperature detecting members.

However, since such a fixing device requires two temperature detecting members, spaces for mounting the two temperature detecting members have to be secured and, in addition, wiring becomes complicated. Further, since the occurrence of entwining with recording sheet cannot be detected until the difference between the temperatures detected by the two temperature detecting members takes on a predetermined value or more, the fixing device involves a problem that it takes a relatively long time to detect the occurrence of entwining with recording sheet.

With respect to these problems, a fixing device capable of controlling the temperature of the heating roller by detecting the temperature with a single temperature detecting member while detecting the occurrence of entwining with recording sheet, is known (see Japanese Patent Laid-Open Publication No. HEI 07-287473 for example).

The fixing device described in Japanese Patent Laid-Open Publication No. HEI 07-287473, however, cannot detect abnormalities including a harness contact failure and a software control failure. These abnormalities make it impossible to control the temperature of the heating roller.

The present invention intends to provide a fixing device capable of detecting various troubles related to the heating roller temperature control thereby obviating an accident such as a fire.

SUMMARY OF THE INVENTION

A fixing device according to the present invention includes a heating roller, driving means, detecting means, and control means. The heating roller has a heating section and is configured to heat a recording medium. The driving means is configured to drive the heating section. The detecting means is configured to detect a surface temperature of the heating roller. The control means is configured to stop an operation of the driving means when the surface temperature of the heating roller exceeds a predetermined value and, thereafter, cause the detecting means to perform detection of the surface temperature of the heating roller for a predetermined time period and issues an alarm about occurrence of a first abnormality when the surface temperature of the heating roller fails to drop in the predetermined time period.

With this arrangement, when it is determined that the surface temperature of the heating roller is higher than a target temperature, the operation of the heating section is stopped and then a change in the surface temperature of the heating roller is detected. By issuing the alarm about the occurrence of an abnormality of the fixing device when the surface temperature of the heating roller fails to drop, it becomes possible to detect abnormalities including a software control failure, a control IC port failure, a harness contact failure, and a soldering failure in a driving circuit, thereby to obviate abnormal conditions such as a fire.

The fixing device according to the present invention is capable of detecting various troubles related to the heating roller temperature control thereby obviating an accident such as a fire.

The foregoing and other features and attendant advantages of the present invention will become more apparent from the reading of the following detailed description of the invention in conjunction with the accompanying drawings.

BRIEF DESCRIPTION OF THE DRAWINGS

FIG. 3 includes a view showing an arrangement of heaters in a heating roller of the fixing device according to the first embodiment of the present invention, and diagrams each showing fixing temperatures corresponding to the respective heaters; specifically, FIG. 3A is a diagram showing fixing temperatures obtained prior to passage of a recording sheet across the heating roller, FIG. 3B is a diagram showing fixing temperatures obtained just after passage of the recording sheet across the heating roller, and FIG. 3C is a diagram showing fixing temperatures obtained just after passage of the recording sheet across the heating roller;

DETAILED DESCRIPTION OF THE INVENTION

Hereinafter, a fixing device and an image forming apparatus including the fixing device according to the best mode for carrying out the present invention will be described in detail with reference to the drawings.

Figure 1:
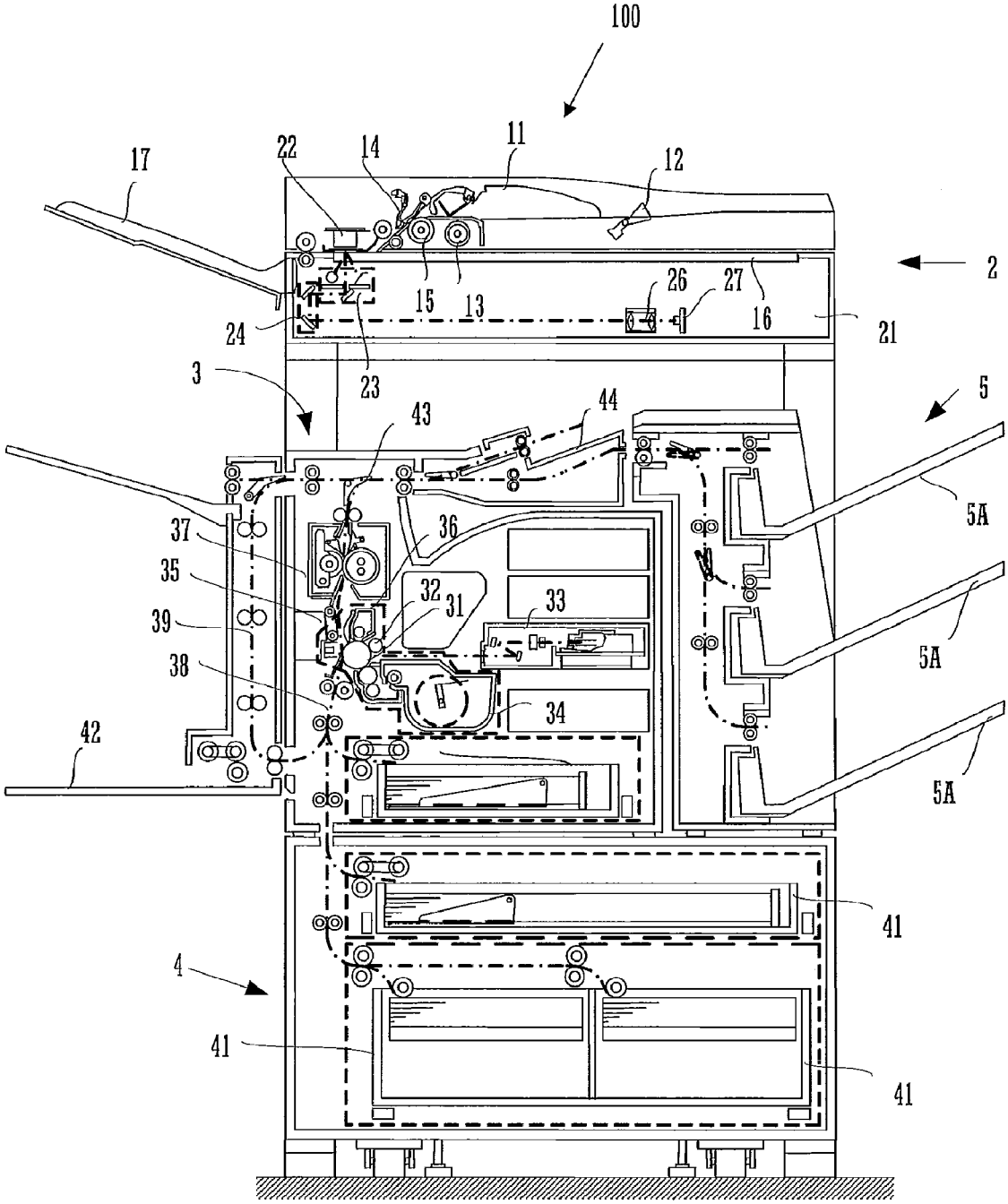
FIG. 1 is a view showing an arrangement of an image forming apparatus including a fixing device according to a first embodiment of the present invention.

FIG. 1 is a view showing an arrangement of an image forming apparatus including a fixing device according to a first embodiment of the present invention.

An image forming apparatus 100 can operate selectively in any one of modes including: a copy mode in which an image is read from a document and then printed on a recording sheet (recording medium); a facsimile mode in which an image is read from a document and then transmitted while an image read from a document is received and then printed on a recording sheet; and a printer mode in which an image received from information terminal equipment via a network is printed on a recording sheet. The image forming apparatus 100 basically includes a document feeding and reading section 2, an image forming section 3, a sheet feeding section 4, and a delivered sheet processing section 5.

The operations of the respective sections of the image forming apparatus 100 in the copy mode for example are described below.

The document feeding and reading section 2 is placed in an upper portion of the image forming apparatus 100. When a document is set on a document set tray 11 of the document feeding and reading section 2, a document detecting sensor 12 detects the document thus set. Then, an operation panel of the document feeding and reading section 2 is operated to input settings including a recording sheet size and a magnification. Thereafter, the operation panel is operated to input an instruction to start copying.

In response to these operations, the document feeding and reading section 2 causes a pickup roller 13 to pick up document sheets on the document set tray 11 one by one and feeds each document sheet onto platen glass 16 by passing it between a separating plate 14 and a feed roller 15. Thereafter, each document sheet is fed over the platen glass 16 in a secondary scanning direction and then delivered onto a document catch tray 17.

As the document sheet passes over the platen glass 16, a first reading section 21 reads an image on the lower side of the document sheet. A first scanning unit 23 of the first reading section 21 is moved to a predetermined position, while a second scanning unit 24 located at a predetermined position. Under this condition, the obverse side of the document sheet is illuminated by an exposure lamp of the first scanning unit 23 through the platen glass 16. Light reflected by the document sheet is guided to an imaging lens 26 by reflecting mirrors of respective of the first and second scanning units 23 and 24 and then focused on a CCD (Charge Coupled Device) 27 through the imaging lens 26. Thus, the image on the lower side of the document sheet is focused on the CCD 27, whereby the image on the lower side of the document sheet is read.

A second reading section 22 reads an image on the upper side of the document sheet. The second reading section 22, which is placed above the platen glass 16, includes an exposure lamp (comprising an LED (Light Emitting Diode) array, a fluorescent lamp or the like) for illuminating the reverse side of the document sheet, a selfoc lens array for focusing light reflected from the document sheet, a contact image sensor (CIS) configured to photoelectrically converting reflected light received from the document sheet through the selfoc lens array and then output analog image signals, and a like component.

When a document sheet is placed on the platen glass 16 with an upper enclosure of the document feeding and reading section 2 opened, an image on the obverse side of the document sheet kept in this condition can be read by the first reading section 21. In this case, the first and second scanning units 23 and 24 are caused to move in the secondary scanning direction while maintaining each other's predetermined speed relationship. By so doing, the document sheet on the platen glass 23 is exposed to light by the first scanning unit 23. The first and second scanning units 23 and 24 guide reflected light from the document sheet to the imaging lens 26, which in turn focuses the document image on the CCD 27.

When the image on one side or the images on both sides of the document sheet are thus read, image data corresponding to each image thus read is inputted to a control section comprising a microcomputer or the like, where the image data is subjected to various types of image processing, and then outputted to the image forming section 3.

The image forming section 3, which is configured to print the document image corresponding to the image data on a recording sheet, includes a photosensitive drum 31, electrostatic charger device 32, laser scanning unit 33, developing device 34, transfer device 35, cleaning device 36, static eliminator, fixing device 37, and a like component.

The image forming section 3 is provided with a main feed path 38 and an overturning feed path 39. A recording sheet fed from the sheet feeding section 4 is fed on the main feed path 38. The sheet feeding section 4 picks up recording sheets accommodated in a sheet cassette 41 or placed on a manual feed tray 42 one by one and feeds each recording sheet into the main feed path 38 of the image forming section 3.

During feeding of the recording sheet on the main feed path 38 of the image forming section 3, the recording sheet passes between the photosensitive drum 31 and the transfer device 35 and then passes through the fixing device 37, so that printing on the recording sheet is achieved. The photosensitive drum 31 rotates in one direction. The surface of the photosensitive drum 31 is cleaned by the cleaning device 36 and the static eliminator and then electrostatically charged uniformly by the electrostatic charger device 32. The laser scanning unit 33 modulates laser light according to the image data transmitted from the document feeding and reading section 2 and repeatedly scans the surface of the photosensitive drum 31 with laser light thus modulated in a primary scanning direction to form an electrostatic latent image on the surface of the photosensitive drum 31. The developing device 34 supplies toner to the surface of the photosensitive drum 31 to develop the electrostatic latent image, thereby forming a toner image on the surface of the photosensitive drum 31. The transfer device 35 transfers the toner image from the surface of the photosensitive drum 31 to the recording sheet passing between the transfer device 35 and the photosensitive drum 31. The fixing device 37 heats and pressurizes the recording sheet to fix the toner image on the recording sheet.

A branching claw 43 is placed at a junction between the main feed path 38 and the overturning feed path 39. When printing is performed on only one side of the recording sheet, the branching claw 43 is positioned to guide the recording sheet fed from the fixing device 37 toward a catch tray 44 or the delivered sheet processing device 5.

When printing is performed on both sides of the recording sheet, the branching claw 43 is caused to pivot in order to guide the recording sheet toward the overturning feed path 39. The recording sheet is overturned by passing through the overturning feed path 39 and then fed into the main feed path 38 again. The recording sheet is subjected to printing on the reverse side thereof during the re-feeding on the main feed path 38 and then guided toward the catch tray 44 or the delivered sheet processing device 5.

The recording sheet thus printed is guided toward the catch tray 44 or the delivered sheet processing device 5 and then delivered to the catch tray 44 or to any one of catch trays 5A of the delivered sheet processing device 5.

The delivered sheet processing device 5 delivers a plurality of such recording sheets to the catch trays 5A in a sorted fashion, or punches or staples the recording sheets. In cases where plural copies of printed matter is to be produced, the delivered sheet processing device 5 sorts the recording sheets in such a manner as to allot one copy of printed matter to each catch tray 5A and punches or staples the recording sheets on each catch tray 5A to produce the printed matter.

Figure 2:
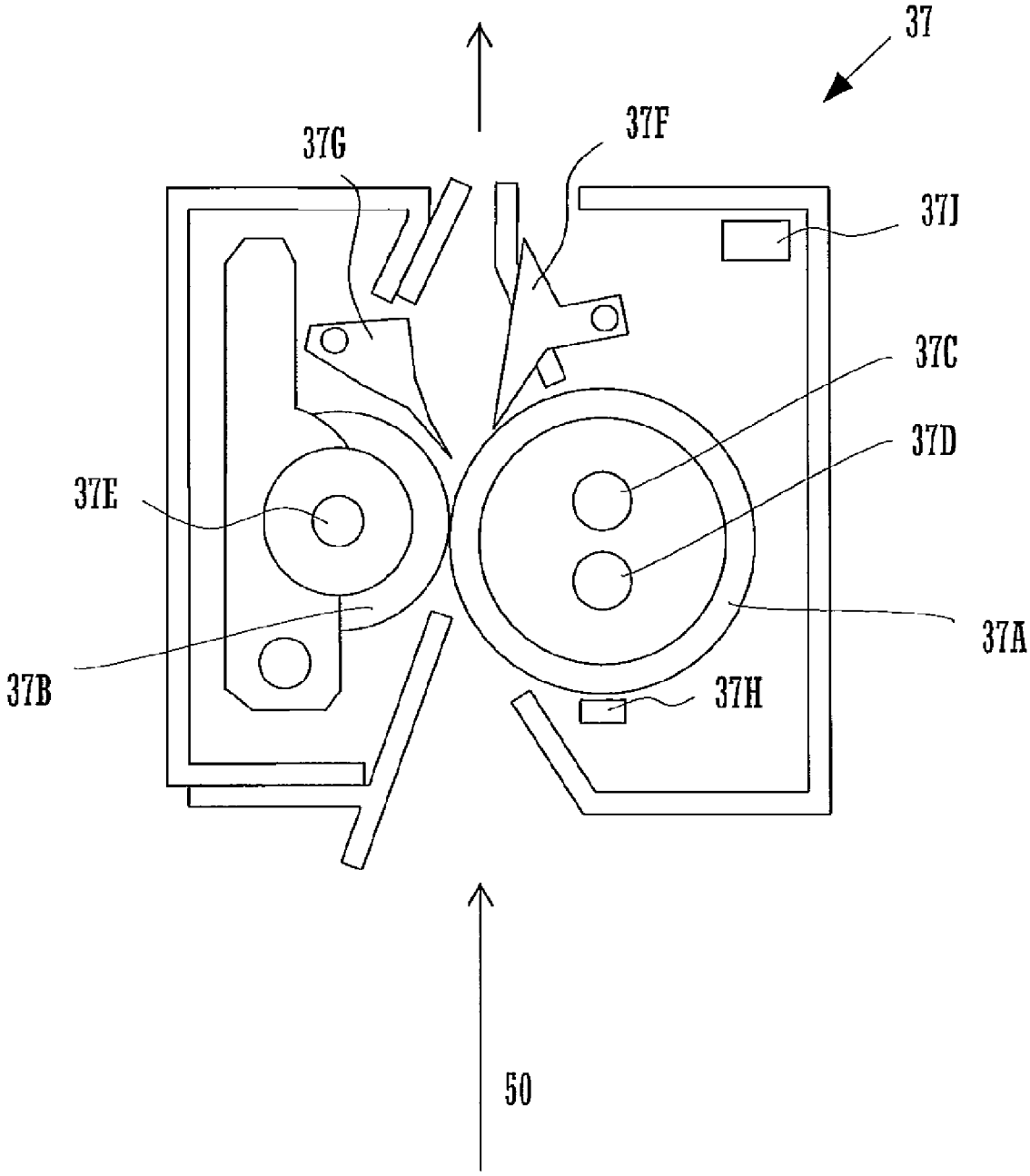
FIG. 2 is a view showing an arrangement of the fixing device according to the first embodiment of the present invention.

FIG. 2 is a view showing an arrangement of the fixing device according to the first embodiment of the present invention.

The fixing device 37 includes a heating roller 37A, pressurizing roller 37B, recording sheet peeling claws 37F and 37G, thermistor 37H, and fixing control section 37J. The thermistor 37H is equivalent to the detecting means defined by the present invention.

The heating roller 37A and the pressurizing roller 37B are positioned to face each other across a plane on which the recording sheet passes. The recording sheet peeling claw 37F is located downstream of the heating roller 37A, while the recording sheet peeling claw 37G located downstream of the pressurizing roller 37B. The thermistor 37H is located close to the surface of the heating roller 37A.

The heating roller 37A has a main heater 37C and a subheater 37D therein. The main heater 37C and the subheater 37D form the heating section defined by the present invention. The main heater 37C heats a central portion of the heating roller 37A. The subheater 37D heats opposite end portions of the heating roller 37C. The main heater 37C and the subheater 37D are individually applied with electric power in a controlled manner so that the whole of the heating roller 37A is heated to a uniform temperature. The pressurizing roller 37B has a heater 37E therein. The heater 37E heats the inside of the pressurizing roller 37B so that the surface temperature of the pressurizing roller 37B becomes lower than the surface temperature of the heating roller 37A. It should be noted that the heater 37E is not an essential element.

The recording sheet is fed in the direction indicated by arrow 50. The heating roller 37A heats the recording sheet to fuse toner on the recording sheet. The pressurizing roller 37B puts the recording sheet between the pressurizing roller 37B and the heating roller 37A and presses against the recording sheet to fix the fused toner on the recording sheet.

Since the recording sheet is heated by the heating roller 37A and pressurized by the pressurizing roller 37B, the recording sheet is sometimes attached to either of the two rollers. When the recording sheet is attached to the heating roller 37A, the recording sheet peeling claw 37F peels off the recording sheet from the heating roller 37A. When the recording sheet is attached to the pressurizing roller 37B, the recording sheet peeling claw 37G peels off the recording sheet from the pressurizing roller 37B. Thereafter, the recording sheet is fed downward on the feed path.

The thermistor 37H measures the surface temperature of the heating roller 37A and transmits the temperature data to the fixing control section 37J. The fixing control section 37J controls the operations of the main heater 37C and subheater 37D based on the temperature data. The fixing control section 37J may be located exteriorly of the fixing device 37.

FIG. 3 includes a view showing an arrangement of heaters in the heating roller of the fixing device according to the first embodiment of the present invention, and diagrams each showing fixing temperatures corresponding to the respective heaters.

The heating roller 37A includes the main heater 37C and subheater 37D as shown. FIGS. 3A to 3C each show fixing temperatures 60 which are controlled surface temperatures of the heating roller 37A over the entire width thereof. FIG. 3A is a diagram showing fixing temperatures 60 obtained prior to passage of a recoding sheet 70 across the heating roller 37A. In FIG. 3A, the fixing temperature 60 of the main heater 37C is higher than that of the subheater 37D. This is because the recording sheet 70 passes across a portion of the heating roller 37A which coincides with the main heater 37C and does not pass across a portion of the heating roller 37A which coincides with the subheater 37D. However, recording sheets of some sizes pass across the portion of the heating roller 37A which coincides with the subheater 37D. For this reason, the portion coinciding with the subheater 37D is preheated so that the surface temperature of the portion coinciding with the subheater 37D can be raised to the same temperature as the surface temperature of the portion coinciding with the main heater 37C without delay at the time a recording sheet of a larger size passes thereacross.

FIG. 3B is a diagram showing fixing temperatures 60 varied from those shown in FIG. 3 just after passage of the recording sheet 70 the heating roller 37A. As the recording sheet 70 passes across the heating roller 37A, the recording sheet 70 derives the heating roller 37A of its surface heat, with the result that the fixing temperature 60 drops temporarily as depicted by dotted line. In order to make up for the heat derived by the recording sheet 70, the main heater 37C is driven to restore the fixing temperature 60 indicated by solid line.

FIG. 3C is a diagram showing fixing temperatures 60 varied from those shown in FIG. 3A just after passage of the recording sheet 70 across the heating roller 37A. The fixing temperature 60 of the subheater 37D shown in FIG. 3C is lower than that shown in FIG. 3B. The fixing temperature 60 of the subheater 37D is thus lowered for the purpose of saving the power consumption when all the recording sheets to be used are of sizes that do not exceed the width of the main heater 37C.

Figure 4:
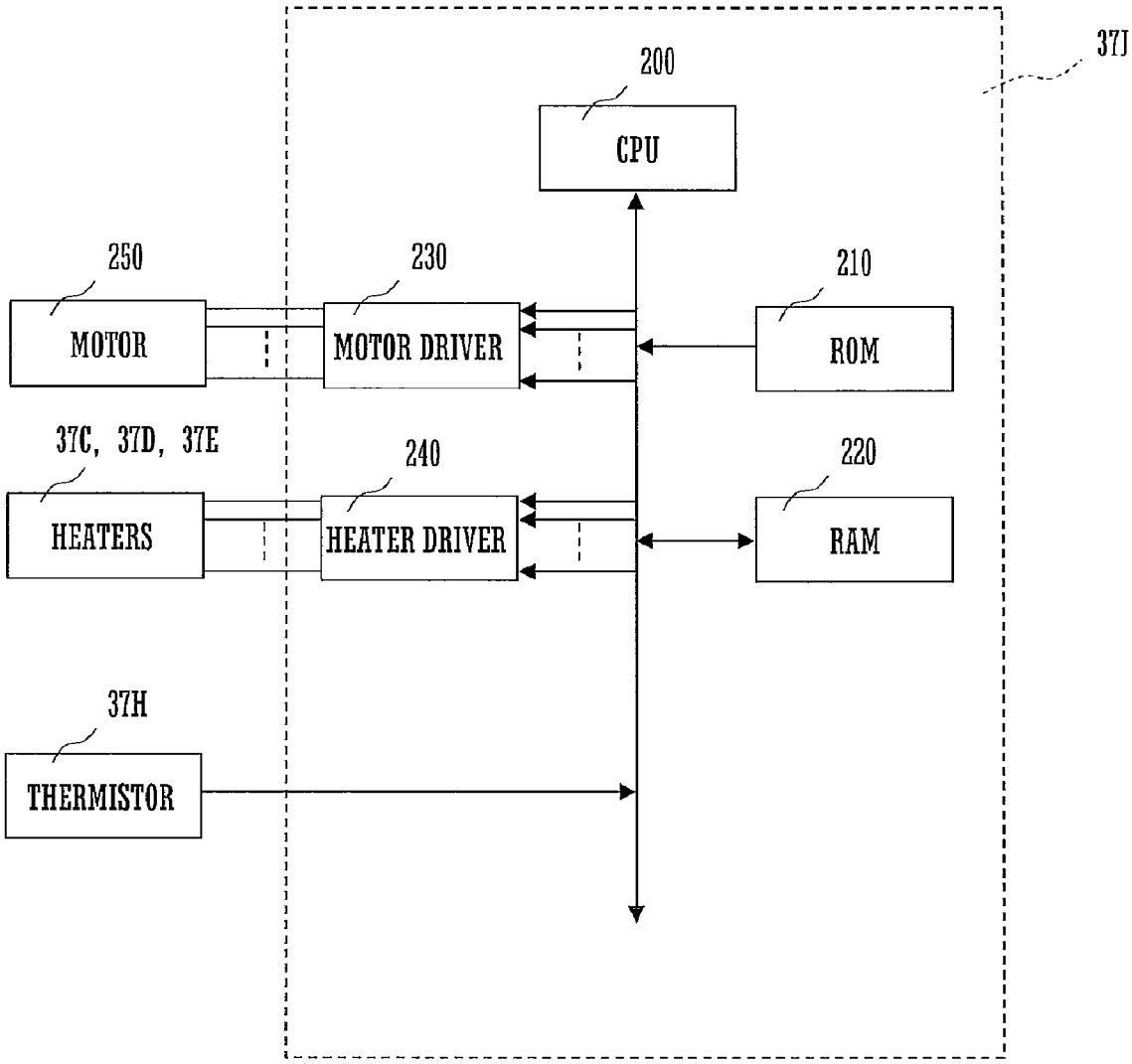
FIG. 4 is a block diagram showing a configuration of a control section of the fixing device according to the first embodiment of the present invention.

FIG. 4 is a block diagram showing a configuration of the control section of the fixing device according to the first embodiment of the present invention.

The fixing control section 37J includes a CPU 200, ROM 210, RAM 220, motor driver 230, and heater driver 240. The CPU 200 is equivalent to the control means defined by the present invention. The heater driver 240 is equivalent to the driving means defined by the present invention. The motor driver 230 is connected to a motor 250. The heater driver 240 is connected to the heaters 37C, 37D and 37E.

The CPU 200 generally controls the RAM 220, motor driver 230 and heater driver 240. The ROM 210 has stored therein various programs related to the operation of the fixing device 37, while the CPU 200 reads the stored data to control the components of the fixing device 37. The RAM 220 is used as a working area for the CPU 200 and assists the CPU 200 in smoothly controlling the components by allowing data to be temporarily stored therein and to be read by the CPU 200. The motor driver 230 drives or stops the motor 250 in response to an instruction from the CPU 200. The heating roller 37A and the pressurizing roller 37B are connected to the motor 250. When the motor 250 is driven, the heating roller 37A and the pressurizing roller 37B rotate. The heater driver 240 drives or stops the heaters 37C, 37D and 37E in response to an instruction from the CPU 200. The heaters 37C and 37D are driven to heat the heating roller 37A, while the heater 37E driven to heat the pressurizing roller 37B.

The thermistor 37H measures the surface temperature of the heating roller 37A and transmits the data thus obtained to the CPU 200. The CPU 200 controls the heater driver 240 based on the data from the thermistor 37H in such a manner as to control the surface temperature of the heating roller 37A by driving the heaters 37C and 37D. In the event that the surface temperature of the heating roller 37A fails to drop even when the operations of the heaters 37C and 370 are stopped due to the surface temperature of the heating roller 37A becoming higher than a target temperature, the CPU 200 determines that an abnormality has occurred at the fixing device 37 and issues an alarm about the occurrence of the abnormality at the fixing device 37 to the outside.

Figure 5:
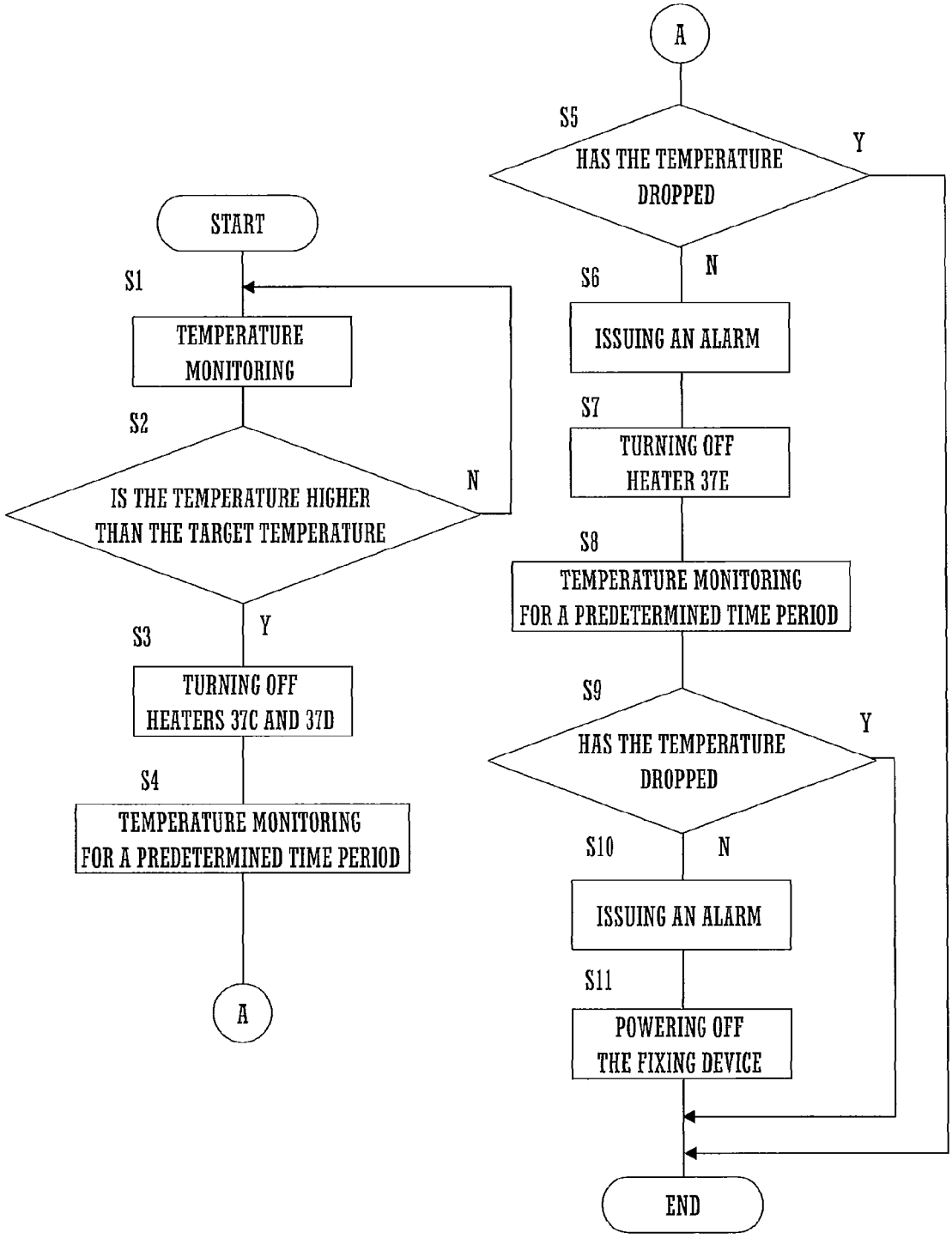
FIG. 5 is a flowchart of a process carried out when a control failure occurs at the fixing device according to the first embodiment of the present invention.

FIG. 5 is a flowchart of a process carried out when a control failure occurs at the fixing device according to the first embodiment of the present invention.

While the power source for the fixing device 37 is ON, the CPU 200 monitors the surface temperature of the heating roller 37A via the thermistor 37H whenever necessary (step S1). If the surface temperature of the heating roller 37A is higher than the target temperature (step S2), the CPU 200 instructs the heater driver 240 to stop driving the heaters 37C and 37D (step S3). Thereafter, the CPU 200 monitors the surface temperature of the heating roller 37A via the thermistor 37H for a predetermined time period (step S4). If the surface temperature of the heating roller 37A fails to drop in the predetermined time period (step S5), the CPU 200 issues an alarm indicative of occurrence of a first abnormality at the fixing device 37A (step S6). After having issued the alarm about the occurrence of the first abnormality, the CPU 200 instructs the heater driver 240 to stop driving the heater E (step S7). After having stopped driving the heater 37E, the CPU 200 monitors the surface temperature of the heating roller 37A via the thermistor 37H for a predetermined time period (step S8). If the surface temperature of the heating roller 37A fails to drop in the predetermined time period (step S9), the CPU 200 issues an alarm about occurrence of a second abnormality at the fixing device 37A (step S10). After having issued the indicative of the occurrence of the second abnormality at the fixing device 37A, the CPU 200 powers OFF the whole of the fixing device 37 (step S11).

Figure 6:
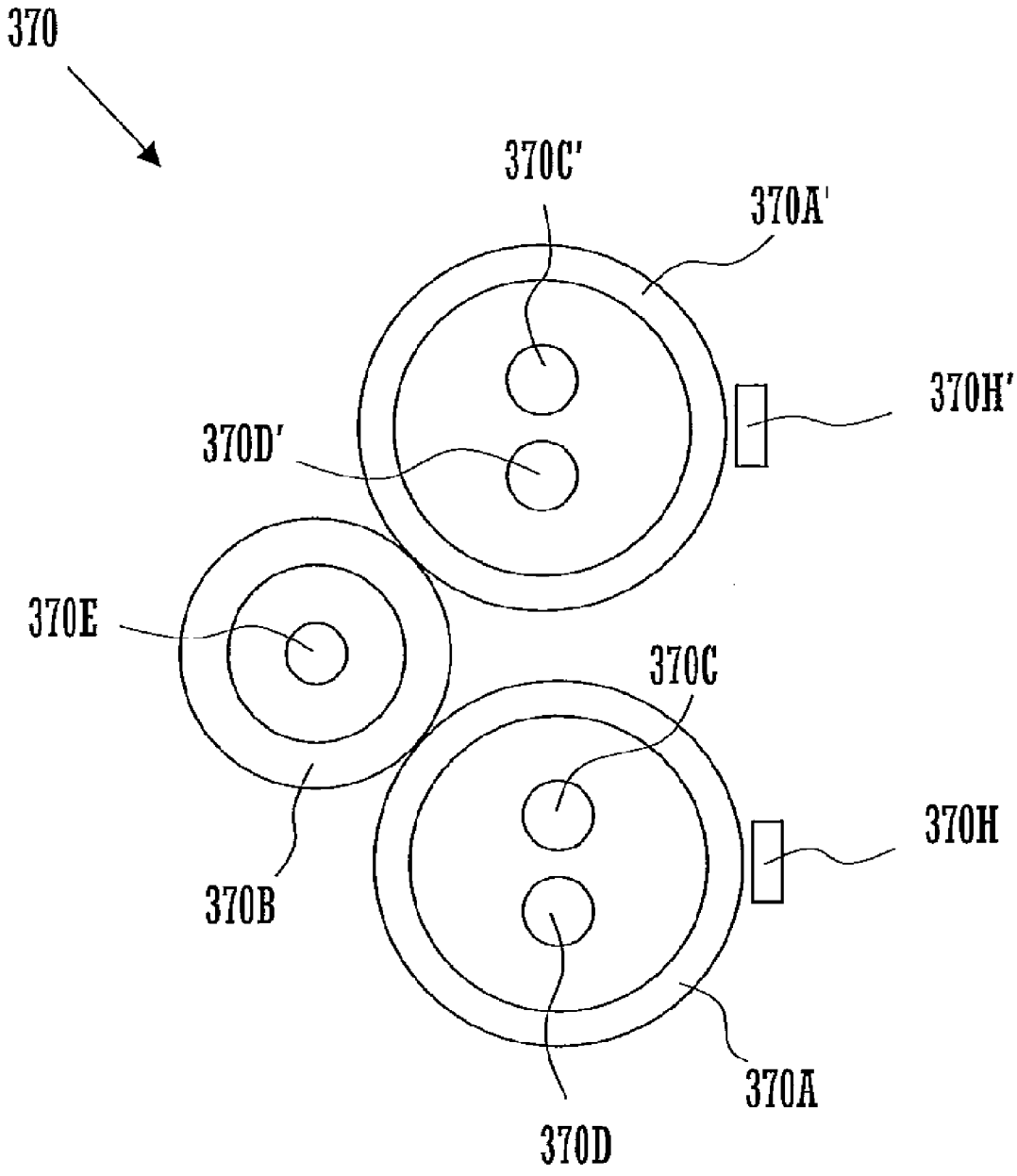
FIG. 6 is a view showing an arrangement of a fixing device according to a second embodiment of the present invention.

FIG. 6 is a view showing an arrangement of a fixing device according to a second embodiment of the present invention.

Some fixing devices are of the type having an arrangement including a plurality of heating rollers, like a fixing device 370 shown in FIG. 6. With this arrangement, when a thermistor 370H' reads a temperature higher than a target temperature, heaters 370C and 370D are first caused to stop operating. If the temperature indicated by the thermistor 370H fails to drop in a predetermined time period, heaters 370C', 370D' and 370E are caused to stop operating.

While the foregoing embodiments are each configured to stop driving each heater when the temperature indicated by the thermistor is higher than the target temperature, the present invention is not limited to this configuration. It is possible to detect an abnormal condition of the fixing device by checking whether or not the temperature indicated by the thermistor drops when all the heaters are stopped at predetermined time intervals regardless of the temperature indicated by the thermistor. In cases other than the case where all the heaters are stopped at predetermined time intervals, including a case where a delay is allowed in starting the next job, such as when the machine is in an idle state, or when preheat transition proceeds, and a case where any delay is not allowed in starting the next job, such as during an initial operation after powering ON, or when printing cannot be started by any other factor, it is possible to detect an abnormal condition of the fixing device by checking whether or not the temperature indicated by the thermistor drops.

The foregoing embodiments are illustrative in all points and should not be construed to limit the present invention. The scope of the present invention is defined not by the foregoing embodiment but by the following claims. Further, the scope of the present invention is intended to include all modifications within the scopes of the claims and within the meanings and scopes of equivalents.

What is claimed is:

1. A fixing device, comprising:

a first roller having a first heating section and configured to heat a recording medium;

a second roller, in contact with the first roller, and having a second heating section for heating the second roller;

driving means configured to drive the first and second heating sections;

detecting means configured to detect a surface temperature of the first roller; and control means configured to control the driving means to stop operation of only the first heating section when the detected surface temperature of the first roller becomes higher than a predetermined temperature, thereafter, issue a first alarm indicative of a first abnormality when the detected surface temperature of the first roller fails to drop within a first predetermined time period after stopping operation of only the first heating section, stop operation of the second heating section after issuance of the first alarm indicative of occurrence of the first abnormality, and thereafter, issue a second alarm indicative of occurrence of a second abnormality when the detected surface temperature of the first roller fails to drop within a second predetermined time period after the driving means stops the second heating section.

2. The fixing device according to claim 1, wherein the control means is configured to stop the operations of said first and second heating sections at predetermined time intervals.

3. The fixing device according to claim 1, wherein the control means is configured to stop applying power to a fixing the fixing device body when the second alarm has issued.

4. An image forming apparatus, comprising:

an image carrier having a surface for forming an electrostatic latent image thereon;

an electrostatic charger device configured to electrostatically charge the surface of the image carrier;

an exposure device configured to expose the surface of the image carrier to light to form the electrostatic latent image;

a developing device configured to develop the electrostatic latent image with use of a developer to form a developer image;

a transfer device configured to transfer the developer image from the surface of the image carrier to a recording medium; and a fixing device as recited in claim 1 which is configured to fix the developer image on the recording medium.

5. The fixing device according to claim 1, wherein the first roller is a heating roller.

6. The fixing device according to claim 5, wherein the second roller is a pressurizing roller in contact with the heating roller.

7. A method of detecting an abnormality of a fixing device, comprising:

driving a first heating section for heating a heating roller in a fixing device body;

driving a second heating section for heating a pressurizing roller in the fixing device;

detecting a surface temperature of the heating roller after having driven the first and second heating section;

stopping an operation of only the first heating section when the detected surface temperature of the heating roller becomes higher than a predetermined value;

issuing a first alarm indicative of occurrence of a first abnormality when the detected surface temperature of the heating roller fails to drop within a first predetermined time period after having stopped the operation of only the first heating section;

stopping the second heating section after issuing the first alarm indicative of occurrence of the first abnormality; and issuing a second alarm indicative of occurrence of a second abnormality when the detected surface temperature of the heating roller fails to drop within a second predetermined time period after having stopped an operation of the second heating section.

* * * * *